United States Patent [19]

Quaggiotti

[11] Patent Number: 5,002,302

[45] Date of Patent: Mar. 26, 1991

[54] DISASSEMBLING DOUBLE-SLIDE SKI

[75] Inventor: Vittorio Quaggiotti, Padova, Italy

[73] Assignee: S.B.P. S.r.l., Padova, Italy

[21] Appl. No.: 481,048

[22] Filed: Feb. 16, 1990

[30] Foreign Application Priority Data

Jul. 17, 1989 [IT] Italy ..... 21206 A/89

[51] Int. Cl.[5] ..... A63C 5/00

[52] U.S. Cl. ..... 280/603; 280/15; 280/16

[58] Field of Search ..... 280/602, 603, 11.15, 280/606, 15, 16, 28, 14.2

[56] References Cited

U.S. PATENT DOCUMENTS 3,717,359 2/1973 Peronnon et al. ..... 280/16
4,138,128 2/1979 Criss ..... 280/16
4,773,659 9/1988 Rygiel ..... 280/16 X
4,878,686 11/1989 Quaggiotti ..... 280/602

*Primary Examiner*—Richard A. Bertsch
*Assistant Examiner*—Michael Mar
*Attorney, Agent, or Firm*—Beveridge, DeGrandi & Weilacher

[57] ABSTRACT

A double-slide ski which can be assembled and disassembled and, if required, shortened, comprising a front slide, and a rear slide aligned to the previous one; the two slides are connected by a tubular arm linked to the front slide and rigidly connected to the rear slide by a sleeve element fastened at the front end of the rear slide, in which the tubular arm is threaded and than blocked in a disengageable manner into the sleeve element with the protruding end of the arm, resting on a rear support pad.

6 Claims, 1 Drawing Sheet

DISASSEMBLING DOUBLE-SLIDE SKI

BACKGROUND OF THE INVENTION

This invention relates to a double-slide ski comprising a front slide and a rear slide axially aligned and interconnecting linking arm by means of which it is possible to separate the two slides when the ski has to be put away in a small space for example to be transported in a motor vehicle, providing at the same time a ski which in many respects is improved and at any rate having the required characteristics of ground-gripping ability stability, ease of use and control, as in a conventional ski of high quality.

From previous patent applications IT-A-41601 A/86 and IT-A-19113 A/89 of the same Applicant a double-slide ski is known which comprises a fore slide having an upwardly curved front end, and a rear slide also having an upwardly curved front end and being greater in length than the front slide; the two slides of the ski are connected to each other by means of an intermediate linking arm designed to maintain the slides aligned longitudinally. The intermediate linking arm is pivoted to the front slide to enable it to rotate around a transverse axis and means for limiting movement are provided betweeen said arm and the front slide to limit the rotation movement of the latter in relation to the rear slide.

According to an embodiment illustrated and described in the patent application IT-A-19113 A/89, the intermediate linking arm is pivoted at the two slides in order to enable the ski to be folded in half, arranging the front slide to match a side of the rear slide. This solution was devised in order to obtain a foldable ski which, although maintaining the general characteristics of the double-slide ski of the previous patent application, at the same time enables its length to be reduced considerably in order to put the ski away in a small space when not in use.

This solution has proved to be of considerable interest since it effectively allows the bulk in length of the ski to be reduced, greatly benefitting its transport. Nevertheless, in both the solutions proposed previously the intermediate linking arm remains permanently pivoted or connected to the two slides causing greater bulk in width when the ski is in the folded condition. Moreover the connection of the arm to the rear slide has to be made by means of locking means which can be engaged and disengaged and which, if inadequate, with the use and repeated stress which a ski normally undergoes, could in time loosen thus in the end jeopardising the use of the ski. In order to avoid this, very precise locking devices could be fitted so as to ensure reliability and duration over the years, nevertheless this would bring about a considerable increase in weight, bulk and in assembly times with overall costs which would in the end be a huge burden and not to be recommended.

From tests and experiments carried out it was however observed that in many cases it is sufficient, if not even preferable, to maintain a rigid connection between the rear slide and the intermediate linking arm allowing at the same time the possibility of disassembling the ski when not in use (radically reducing its bulk), the possibility of varying its length to some extent when in use being in any case of interest.

Within the sphere of the aforementioned object, the intent is now to propose a new ski structure comprising the improved characteristics of the double-slide ski according to the previous patent applications of the same Applicant, and which at the same time provides a ski which can be assembled and disassembled or merely shortened, when not in use, and may be varied in length when in conditions of use, the latter conditions being however ensured by a rigid and disengageable connection between the rear slide and the intermediate linking arm.

A further object of the invention is to provide a double-slide ski which can be assembled and disassembled as related to above, whereby the front slide can be easily separated and removed or replaced and reconnected to the rear slide by means of an extremely simple and highly reliable connection system.

SUMMARY OF THE INVENTION

According to the general principles of this invention a double-slide ski is thus provided comprising a front slide, a rear slide and an intermediate linking arm designed to maintain the two slides longitudinally aligned, whereby the intermediate linking arm comprises a tubular element pivoted to an intermediate point of the front slide and rigidly connected to the front end of the rear slide, and in which biasing means for limiting movement are provided between the intermediate linking arm and the front slide, said tubular element of the intermediate linking arm extending toward the rear slide through a sleeved element provided at the front end of the rear slide, one end of said tubular element extending beyond and throught said sleeve element, towards and above a rear resting element, engageable and disengageable locking means being provided for locking the arm in the sleeve preventing the rotational movement and axial sliding of said tubular element in relation to the aforementioned sleeve element.

BRIEF DESCRIPTION OF THE DRAWINGS

The ski according to this invention will be illustrated in greater detail hereunder with reference to the accompanying exemplifying drawings, in which.

DESCRIPTION OF THE INVENTION

Figure 1:
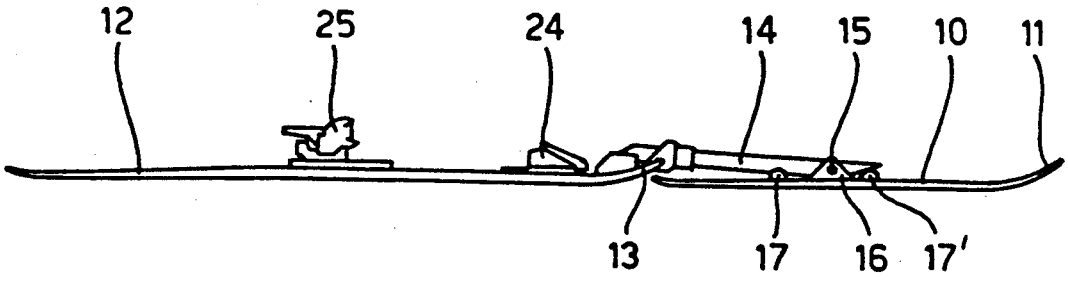
FIG. 1 shows a side view of a double-slide ski according to the invention.
Figure 2:
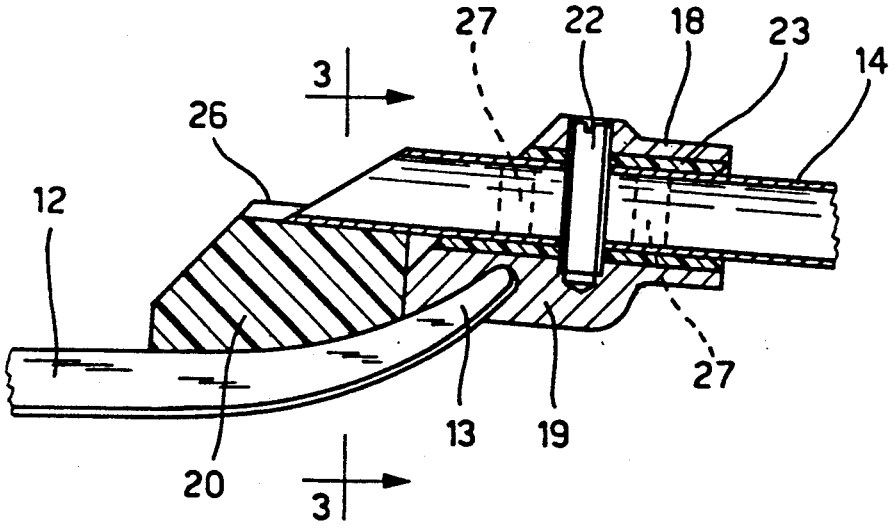
FIG. 2 shows an enlarged longitudinal sectional view of the system for connecting the front slide to the rear slide of the ski.
Figure 3:
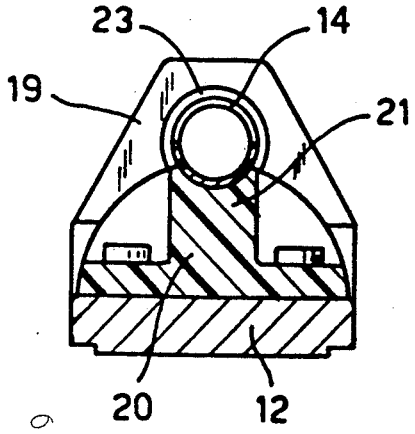
FIG. 3 is a cross-sectional view along the line 3—3 of FIG. 2.

FIG. 1 shows a double-slide ski according to the invention, comprising a front slide 10 having a front end 11 turned upwards, and a rear slide 12 having a front end 13 turned upwards. The two slides 10 and 12 of the ski are connected to each other and are maintained in a longitudinally aligned condition by menas of an intermediate linking arm comprising a tubular element 14 pivoted in 15 to a bracket 16 fixed in an intermediate point of the front slide 10. Elastically yielding means for restricting or limiting movement, schematically indicated by 17 and 17', are provided between the tubular arm 14 and the front slide 10, as shown. If the elastic movement limiting means 17 rearwardly positioned to the hinging 15 is composed of a double-action elastic member i.e. acting in both directions of rotation of the arm 14, the forward limiting means 17' could be eliminated, otherwise both must be envisaged, for example by using adequate resilient pads. The tubular arm 14 extends rearwardly, beyond the rear end or tail of the front slide 10, to be inserted into a sleeve element 18 integral with or forming part of a support member 19 rigidly connected to the tip or front end 13 of the rear slide. In particular, as can be seen in FIG. 2, the tubular arm 14 with its end can extend to the rear and beyond the sleeve element 18, towards and above a rear resting element 20 comprising a semirigid pad member for example elastomeric material fixed to the rear slide.

A pin, a screw 22, or other removable fastening means which can be engaged and disengaged with the sleeve 18 can be provided to connect the arm 14 rigidly to the sleeve 18 of the support member 19 so that the arm 14 has no possibility whatsoever of sliding longitudinally or rotating around itself.

As in the case shown, the sleeve element 18 can comprise an inner sheath 23 in plastic or other self-lubricating material, whose front end is bevelled to conform with that of the sleeve 18 in order to facilitate the insertion of the tubular arm 14. Likewise the end of the latter is cut in a slanted plain or may have a cone-shaped tip to facilitate further the introduction of the arm 14 into the sleeve 18 to connect the two slides of the ski.

In order to obtain a rigid connection between the arm 14 and the sleeve element 18, the internal dimensions of the hole in the sleeve 18 and the external dimensions of the tubular element 14 have to be adequately calibrated to prevent the formation of slack; moreover, in the case whereby an internal sheath 23 of adequate thickness is used, any elastic yielding of the sheath 23 would be eliminated by the rear pad element 20 supporting the arm. This support element is preferably in the form of a semirigid pad in plastic material, for example in ABS, nylon, PVC or another elastomeric material which can be fixed directly to the rear slide 12 of the ski as an element separate from the support member 19, or in any case fixed directly to the latter.

Finally 24 and 25 in FIG. 1 indicate a tip and heel of a ski-boot binding at the rear slide 12 of the ski.

In the case described and illustrated in FIG. 2, the connection between the tubular arm 14 and the sleeve element 18 is obtained by means of a pin or a screw which can be threaded into aligned holes suitably provided in the sleeve 18 and in the tubular element 14 of the arm; nevertheless it is clear that other rapid locking devices and systems can be used to rapidly engage and disengage the arm 14 in the sleeve 18.

From what has been said and shown it is clear that the assembly and disassembly of the ski according to this invention is extremely rapid and practical since to separate the front slide 10 from the rear slide 12 it is sufficient to remove the pin or locking element 22, remove the tubular arm 14 from the sleeve 18 by sliding longitudinally until it comes out completely. In these conditions the slides of the ski can therefore be easily put away, transported and handled, and the same ski if necessary can be rapidly and easily restored by simply reinserting the tubular arm 14 into the sleeve 18 of the rear slide, until it rests on the rear support 20 which may if required be provided with a stopping shoulder 26, relocking the whole by means of the pin or an adequate locking device 22.

The shoulder 26 is not essential since correct positioning is guaranteed with precision by the pin 22; therefore the shoulder 26 can be eliminated, whereas various close holes in the arm 14 can be provided for the pin 22, so that two or more assembling positions for the slides are provided for different lengths of the ski. The sleeve 18 and linking arm 14 are in the form of tubular elements but they may be differently shaped while allowing a rigid interconnection by a sliding movement.

What is claimed is:

1. A double-slide ski comprising front and rear slides and an intermediate linking arm to maintain the two slides aligned longitudinally, said intermediate linking arm being pivoted at a forward end to an intermediate point of the front slide and rigidly connected at a rearward portion to the front end of the rear slide, elastically yielding movement limiting means provided between the intermediate linking arm and the front slide, interconnecting means for disengaging and rigidly interconnecting said intermediate arm to said front end of said rear slide, said interconnecting means comprising a sleeve element at the front end of the rear slide, a rearward end of said linking arm passing through and extending beyond said sleeve element, a resting element on the rear slide for engaging and supporting said rearward end of said linking arm, and engageable and disengageable locking means for locking the arm in said sleeve element to prevent rotational and axially sliding movement of said arm in relation to said sleeve element.

2. A double-slide ski as in claim 1, in which said sleeve element includes an inner sheath made of self-lubricating material.

3. A double-slide ski as in claim 1, in which said resting element for supporting said linking arm comprises an elastomeric semirigid pad.

4. A double-slide ski as in claim 1, in which said linking arm has a slanted cut end or is provided with a conical tip.

5. A double-slide ski as in claim 1, in which said resting element for supporting said rearward end of said linking arm is fastened to a supporting part for said sleeve element.

6. A double-slide ski comprising:

a front slide having an upwardly turned tip portion, a rear slide having an upwardly turned tip portion, said rear slide being longitudinally aligned and being longer than the front slide; engageable and disengageable linking means between the front slide and the rear slide to maintain said slides longitudinalaly aligned, said linking means being pivotally connected to said front slide and rigidly connected to said rear slide, movement limiting means between said linking means and said front slide, said linking means including a tubular arm element pivoted at a forward end to the front slide, said tubular arm extending rearwardly and through a tubular sleeve element fixed to the front end of the rear slide, said tubular arm element being fitted in an axially sliding manner and projecting through said tubular sleeve element, toward a support element positioned rearwardly of said sleeve and for supporting a rearward end of said tubular arm element, engageable and disengageable locking means in said tubular arm and sleeve elements for rigidly locking said tubular arm at different axial dispositions into said sleeve element.

* * * * *